United States Patent [19]

Klagmann

[11] Patent Number: 4,494,322

[45] Date of Patent: Jan. 22, 1985

[54] SHOE

[75] Inventor: Josef Klagmann, Rastatt, Fed. Rep. of Germany

[73] Assignee: Golden Team Sportartikel GmbH, Weinheim, Fed. Rep. of Germany

[21] Appl. No.: 414,840

[22] Filed: Sep. 3, 1982

[30] Foreign Application Priority Data

Sep. 11, 1981 [DE] Fed. Rep. of Germany ..... 3136081

[51] Int. Cl.[3] ..... A43B 13/16; A43B 13/20

[52] U.S. Cl. ..... 36/28; 36/29; 36/30 R; 36/32 R

[58] Field of Search ..... 36/28, 29, 30 R, 25 R, 36/32 R, 3 B, 11.5

[56] References Cited

U.S. PATENT DOCUMENTS

| | | | |
|---|---|---|---|
| 1,785,410 | 12/1930 | Gilkerson | 36/28 |
| 1,807,341 | 5/1931 | Messler | 36/28 |
| 2,460,097 | 1/1949 | Maling | 36/30 R |
| 3,972,135 | 8/1976 | Pietraszek | 36/30 R |
| 4,102,061 | 7/1978 | Saaristo | 36/28 |
| 4,128,950 | 12/1978 | Bowerman et al. | 36/28 |
| 4,237,627 | 12/1980 | Turner | 36/29 |
| 4,246,708 | 1/1981 | Gladek | 36/30 R |
| 4,354,318 | 10/1982 | Frederick et al. | 36/30 R |

FOREIGN PATENT DOCUMENTS

| | | | |
|---|---|---|---|
| 1031317 | 6/1953 | France | 36/3 B |

*Primary Examiner*—Henry S. Jaudon
*Assistant Examiner*—Steven N. Meyers
*Attorney, Agent, or Firm*—Herbert L. Lerner; Laurence A. Greenberg

[57] ABSTRACT

Shoe, including a relatively thin inner sole, an outer sole and an elastic intermediate sole disposed between the inner and outer soles, defining a tip, a heel, and regions accommodating the toes, the roots of the toes and the ball of the foot including a step point, the inner sole being substantially horizontal from the tip of the shoe to a location between the step point of the region accommodating the ball of the foot and the heel of the shoe, the intermediate sole having a relatively strong construction in vicinity of the region accommodating the ball of the foot and having an upwardly tapered section from the region accommodating the roots of the toes to the tip of the shoe, the intermediate sole having a multiplicity of holes formed therein in the region accommodating the toes for additionally reducing the hardness of the intermediate sole in the region accommodating the toes.

14 Claims, 3 Drawing Figures

SHOE

The invention relates to a shoe having a thin inner sole, an outer sole, and an elastic intermediate sole disposed therebetween.

Shoes are known in which the inner sole and the outer sole, as well as the intermediate sole if present, are slanted upward to facilitate the rolling-off action of the foot when walking. However, due to the position of the inner sole which is pulled up toward the front point or tip of the shoe, the heads of the metatarsal bones lie in a lower position than the toe points. In a shoe of this type, the foot cannot roll off naturally when walking, but instead can only bend abruptly. This bending is aggravated by the fact that the soles are directed upward from the ball of the foot forward to the point of the shoe. In addition to this factor, a condition exists which is that the soles that are often too hard obstruct the natural functioning of the soft cushioned parts of the sole of the foot, and especially of the toes, which leads to a deformation of the anatomical structure, and especially to a shrinking of the muscles which move the toes. The performance capability of the wearer of the shoe is therefore greatly reduced.

However, making the sole of the shoe very soft also does not represent a good solution to this problem for an adult, because a sole of the thickness and softness degree of the upper leather part of the shoe cannot protect the foot from cold, moisture and lesions caused by uneven ground conditions and pointed stones, and because the majority of people today have feet which are damaged to the point that they require strong support by a shoe.

It is accordingly an object of the invention to provide a shoe which overcomes the hereinfore-mentioned disadvantages of the heretofore-known shoes of this general type, and to do so in a way which assures a healthy position of the foot in the shoe, and a natural rolling and gripping motion of the foot when walking.

With the foregoing and other objects in view there is provided, in accordance with the invention, a shoe, including a relatively thin inner sole, an outer sole and an elastic intermediate sole disposed between the inner and outer soles, defining a tip, a heel and regions accommodating the toes, the roots or bases of the toes and the ball of the foot including a step point, the inner sole being substantially horizontal from the tip of the shoe to a location between the step point of the region accommodating the ball of the foot and the heel of the shoe, the intermediate sole having a relatively strong construction in vicinity of the region accommodating the ball of the foot and having an upwardly tapered section from the region accommodating the roots of the toes to the tip of the shoe, the intermediate sole having a multiplicity of holes formed therein in the region accommodating the toes for additionally reducing the hardness of the intermediate sole in the region accommodating the toes. The horizontal orientation of the inner sole in the forward part of the shoe assures that the points of the toes in the rest position lie at the same height as the head of the metatarsal bones. The pronounced upward pointing of the intermediate sole, i.e. the upwardly directed tapering of the sole toward the point of the shoe, permits the rolling off-motion of the foot when walking.

Finally, the holes in the toe region of the intermediate sole serve the purpose of making the sole softer in this region than in the region from the root of the toes to the heel, and thereby permit a gripping of the toes.

The shoe according to the invention fulfills all possible demands. The low position of the points of the toe not only favors the roll-off and gripping motion when walking, but also allows the foot to perform its natural gripping motion with the toes.

In accordance with another feature of the invention, the intermediate sole is between 17 and 26 mm thick in the region accommodating the ball of the foot, and the upwardly tapered section is tapered to a thickness of between 0 and 1 mm.

In accordance with a further feature of the invention, the intermediate sole is in the form of an upper sole and a lower sole being cemented to each other, the upper sole being tapered down in the shape of a wedge from the heel to the tip of the shoe and having less elasticity than the lower sole.

In accordance with an added feature of the invention, the intermediate sole has other holes formed therein from the region accommodating the roots of the toes to the heel of the shoe, the other holes being less numerous and less concentrated than the first-mentioned holes in the region accommodating the toes.

In accordance with an additional feature of the invention, the first-mentioned holes in the region accommodating the toes are relatively smaller and more numerous than the other holes from the region accommodating the roots of the toes to the heel of the shoe.

In accordance with still another feature of the invention, the holes in the heel of the shoe are exclusively disposed toward the middle of the heel.

In accordance with again another feature of the invention, the holes are formed in the upper and lower soles and the holes in the upper sole are displaced relative to the holes in the lower sole.

In accordance with again an added feature of the invention, the upper sole has less holes formed therein than the lower sole.

In accordance with yet another feature of the invention, the holes are blind holes.

In accordance with still a further feature of the invention, the blind holes are formed in the lower surface of the intermediate sole.

In accordance with again an added feature of the invention, the inner sole is an exchangeable foot support.

In accordance with yet an added feature of the invention, the outer sole is formed of a relatively thin and tough flexible material.

In accordance with a concomitant feature of the invention, the inner, intermediate and outer soles each have a substantially straight edge formed along the side of a region accommodating the big toe.

Other features which are considered as characteristic for the invention are set forth in the appended claims.

Although the invention is illustrated and described herein as embodied in a shoe, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood fron the following description of specific embodiments when read in connection with the accompanying drawings, in which.

Figure 1:
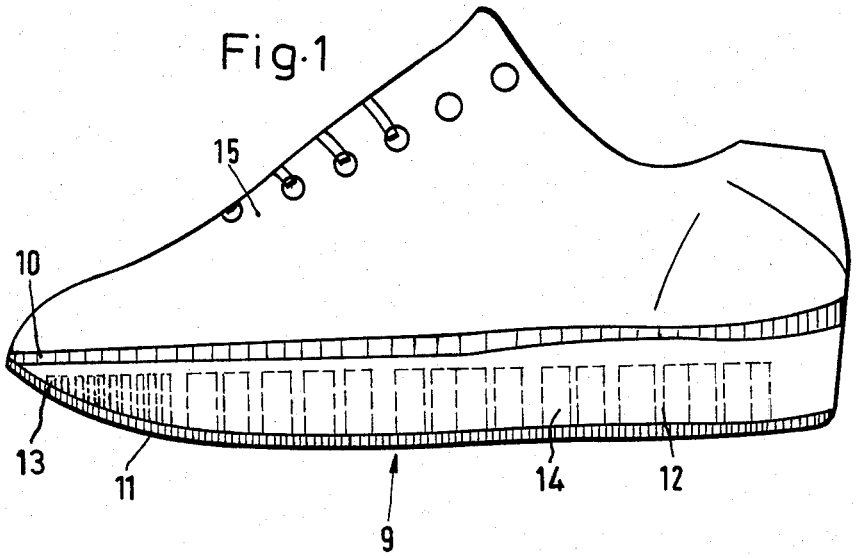
FIG. 1 is a diagrammatic, side elevational view of a shoe according to the invention.

Referring now to the figures of the drawing and first particularly to the shoe according to FIG. 1 thereof, it is seen that beginning from a region 9 behind or toward the heel from the step point of the balls of the foot, and extending forward to the tip of the shoe, there is a horizontal inner sole 10 and a thin bottom or outer sole 11 formed of a flexible material. The step point is the point at which the ball of the foot touches down while taking a step. An elastic intermediate sole 12 having an especially strong construction is disposed between the two soles 10 and 11. The thickness of the intermediate sole 12 depends on the shoe-size, and is between 17 and 26 mm in the metatarsal region. the intermediate sole 12 tapers down to between 1 and 0 mm from the root of the toe to the point of the shoe, so that its lower surface is directed upward, because its upper surface lies along the horizontal inner sole 10. This construction achieves an optimal rolling-off action of the foot when walking, without resulting in a bending of the toe joints.

Figure 2:
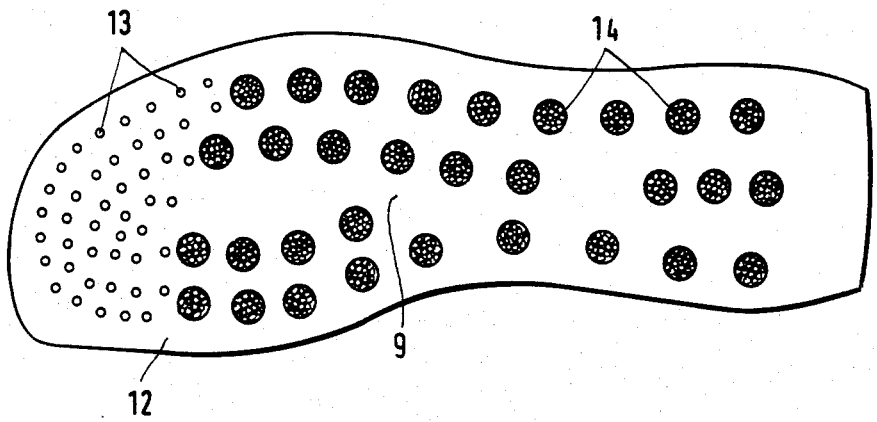
FIG. 2 is a bottom plan view of the intermediate sole of the shoe according to FIG. 1.

As seen in FIG. 2, the intermediate sole 12 is provided with a great number of holes 13 in the toe region, which additionally reduce the hardness of the intermediate sole in this area. Additional holes 14 are provided in the region between the root of the toes and the heel in the intermediate sole 12, but the number and concentration of these holes is less than that of the holes 13. The holes dispersed over the whole area of the intermediate sole 12 enhance the capability of the foot to feel and adapt itself to the ground, particularly on uneven terrain. This reduces the risk of an accident by twisting an ankle. The holes 14 are formed toward the middle of the heel in the heel region, to guide the heel of the foot toward the central axis of the shoe.

The holes 13 and 14 can be through holes, but they can also be in the form of blind holes. For the last-mentioned case, it is practical to form the blind holes in the lower surface of the intermediate sole 12.

In the illustrated embodiment, the inner sole 10 is fixedly connected to the intermediate sole 12 and the upper leather portion 15 of the shoe. However, the inner sole 10 can also be constructed in the form of an exchangeable foot support. In this case, it is possible to provide the foot support in various hardness grades, so that the user of the shoe can choose a softer foot support for hard terrain, and a harder foot support for soft ground.

At the side of the big toe, all of the soles 10 and 12 have a substantially straight edge, so that the soles are a natural likeness of the foot, and the toes are not compressed in an unnatural way.

Figure 3:
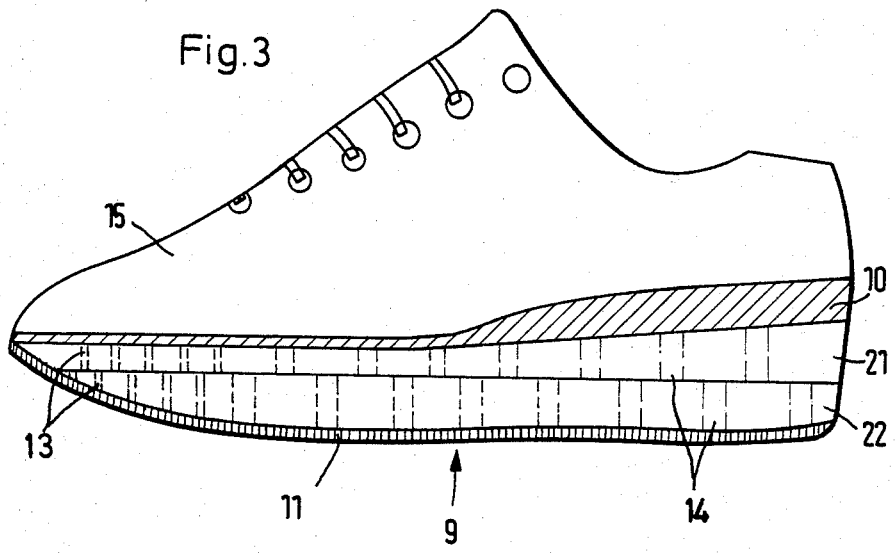
FIG. 3 is a view similar to FIG. 1 of a second embodiment of a shoe according to the invention.

The shoe according to the second embodiment of FIG. 3 differs from the first embodiment only by the feature that the intermediate sole is divided into two soles 21 and 22, which are cemented to each other. The upper sole 21 tapers down in the shape of a wedge from the heel toward the tip of the shoe, and is less elastic than the lower sole 22. This has the effect of allowing the shoe to compensate for unevenness or roughness of the road, for pointed stones and the like, because of the higher elasticity of the lower sole 22, while assuring that the stability of the shoe and support to the foot remains because of the lower elasticity of the upper sole 21.

Both of the soles 21 and 22 are provided with holes 13 and 14 as in the intermediate sole 12 of the first embodiment, in order to reduce the hardness of the soles in the designated regions. The holes 13 and 14 in the upper sole 21 are suitably displaced with respect to those in the lower sole 22. Furthermore, the upper sole 21 has a smaller number of holes 13 and 14 than the lower sole 22 to maintain the difference in the elasticity of the two soles as described above.

The bent-up portion of the lower sole 11, which only begins in vicinity of the root of the toes, and the horizontal orientation of the inner sole 10 beginning from the region 9 behind the step point of the balls of the foot and extending to the point of the shoe, in combination with the soft bedding of the toes, allows the natural bending motion of the toes in the shoe in a manner that was never provided heretofore.

The shoe according to the invention can be manufactured in the conventional manner from various materials. It can also be manufactured as a whole or in parts by injection molding or by stamping. The foregoing is a description corresponding to German Application No. P 31 36 081.5, dated Sept. 11, 1981, the International priority of which is being claimed for the instant application, and which is hereby made part of this application.

I claim:

1. Shoe, comprising a relatively thin inner sole, an outer sole and an elastic intermediate sole disposed between said inner and outer soles, defining a tip, a heel, and regions accommodating the toes, the roots of the toes and the ball of the foot including a step point, said inner sole being substantially horizontal from the tip of the shoe to a location between the step point of the region accommodating the ball of the foot and the heel of the shoe, said intermediate sole having an upwardly tapered section from the region accommodating the roots of the toes to the tip of the shoe, said intermediate sole having multiplicity of holes formed therein in the region accommodating the toes for additionally reducing the hardness of said intermediate sole in the region accommodating the toes, and said intermediate sole having other holes formed therein from the region accommodating the roots of the toes to the heel of the shoe, said other holes being less numerous and less concentrated than said first-mentioned holes in the region accommodating the toes.

2. Shoe, according to claim 1, wherein said intermediate sole is between 17 and 26 mm thick in the region accommodating the ball of the foot, and said upwardly tapered section is tapered to a thickness of between 0 and 1 mm.

3. Shoe, comprising a relatively thin inner sole, an outer sole and an elastic intermediate sole disposed between said inner and outer soles, defining a tip, a heel, and regions accommodating the toes, the roots of the toes and the ball of the foot including a step point, said inner sole being substantially horizontal from the tip of the shoe to a location between the step point of the region accommodating the ball of the foot and the heel of the shoe, said intermediate sole having a relatively strong construction in vicinity of the region accommodating the ball of the foot as compared to the remainder of said intermediate sole and having an upwardly tapered section from the region accommodating the roots of the toes to the tip of the shoe, said intermediate sole having a multiplicity of holes formed therein in the region accommodating the toes for additionally reducing the hardness of said intermediate sole in the region accommodating the toes, said intermediate sole being in the form of an upper sole and a lower sole being cemented to each other, said upper sole being tapered down in the shape of a wedge from the heel to the tip of the shoe and having less elasticity than said lower sole.

4. Shoe according to claim 3, wherein said intermediate sole has other holes formed therein from the region accommodating the roots of the toes to the heel of the shoe, said other holes being less numerous and less concentrated than said first-mentioned holes in the region accommodating the toes.

5. Shoe according to claim 4, wherein said first-mentioned holes in the region accommodating the toes are relatively smaller and more numerous than said other holes from the region accommodating the roots of the toes to the heel of the shoe.

6. Shoe according to claim 4, wherein said holes in the heel of the shoe are exclusively disposed toward the middle of the heel.

7. Shoe according to claim 5, wherein said holes in the heel of the shoe are exclusively disposed toward the middle of the heel.

8. Shoe according to claim 3, wherein said holes are formed in said upper and lower soles and said holes in said upper sole are displaced relative to said holes in said lower sole.

9. Shoe according to claim 8, wherein said upper sole has less holes formed therein than said lower sole.

10. Shoe according to claim 1, wherein said holes are blind holes.

11. Shoe according to claim 10, wherein said blind holes are formed in the lower surface of said intermediate sole.

12. Shoe according to claim 1, wherein said inner sole is an exchangeble foot support.

13. Shoe according to claim 1, wherein said outer sole is formed of a relatively thin and tough flexible material.

14. Shoe according to claim 1, wherein said inner, intermediate and outer soles each have a substantially straight edge-formed along the side of a region accommodating the big toe.

* * * * *